US005558213A

United States Patent [19]

Sutherland

[11] Patent Number: 5,558,213

[45] Date of Patent: Sep. 24, 1996

[54] WRAP-AROUND CARRIER WITH BAR CODE BLOCKER

[75] Inventor: Robert L. Sutherland, Kennesaw, Ga.

[73] Assignee: Riverwood International Corporation, Atlanta, Ga.

[21] Appl. No.: 490,479

[22] Filed: Jun. 14, 1995

Related U.S. Application Data

[63] Continuation-in-part of Ser. No. 335,930, Nov. 8, 1994.

[51] Int. Cl.[6] ..... B65D 75/00

[52] U.S. Cl. ..... 206/147; 206/427

[58] Field of Search ..... 206/139, 140, 206/141, 145, 147, 427, 434

[56] References Cited

U.S. PATENT DOCUMENTS 3,669,342 6/1972 Funkhouser ..... 206/434 X 5,060,792 10/1991 Oliff ..... 206/140

5,311,984 5/1994 Harris ..... 206/434 X 5,360,104 11/1994 Sutherland ..... 206/147

*Primary Examiner*—Jacob K. Ackun

[57] ABSTRACT

A wrap-around carrier including partial end panels extending up from the bottom panel for covering the pricing code on the end articles in the package. The partial end panels are comprised of partially overlapped flaps connected to partially overlapped bottom panel flaps. The end panel flaps contain fold lines which allow the flaps to follow the curved contour of adjacent articles. The end panel flaps are connected to each other by a portion of the overlapped flap fitting into a notch in the overlapping flap. Angle panels and side panel locking flaps connect the end panel flaps to the side panels.

13 Claims, 3 Drawing Sheets

WRAP-AROUND CARRIER WITH BAR CODE BLOCKER

CROSS REFERENCE TO RELATED APPLICATION

This application is a continuation-in-part of application Ser. No. 08/335,930, filed Nov. 8, 1994.

FIELD OF THE INVENTION

This invention relates to wrap-around article carriers. More particularly, it relates to wrap-around carriers which include partial end panels capable of blocking the pricing code printed on the end articles in the carrier.

BACKGROUND OF THE INVENTION

Certain types of articles, such as food or beverage containers, are commonly sold either as individual units or in a multi-container carton. Each article is normally marked with a bar pricing code to enable it to be scanned and automatically totaled at a retail outlet when sold as an individual item. When packaged in conventional open-ended wrap-around carriers, pricing errors can occur if the scanner sees the pricing code on one of the articles instead of the code on the package itself. One way to prevent this from happening is to package the articles in a completely enclosed carton or carrier. An enclosed carrier is quite expensive, however, compared to a wrap-around carrier due to the greater amount of stock required.

It is preferred to provide wrap-around carriers with partial end panels of a size sufficient to cover the pricing code on the end articles in the package. Such a design requires less stock than a fully enclosed carrier and is correspondingly more economical to produce. Partial end panels designed to cover pricing codes located near the bottom of the article require only a short panel extending up from the bottom panel. Ideally, the short end panels should be large enough to cover the pricing code of the end articles, should not interfere with the normal fabrication and packaging methods of wrap-around carriers and should be locked in place after being formed.

A carrier design which provides all these desirable features is described in the above-mentioned application Ser. No. 08/335,930. In that design short end panels are connected to the bottom panel and to angle panels, the latter being connected to side panel locking panels. Upon folding the carrier into place the end panels are automatically folded up and locked into place as a result of the folded locking panels being tightly held between the side panels and adjacent packaged articles. Even though the end panels normally protect against the pricing code on individual articles in the carrier being mistakenly scanned, it would be advantageous to provide still more protection to ensure that this does not occur in packages where portions of the end articles are spaced from the end panels, as when the articles are curved.

The main object of the invention, therefore, is to provide a wrap-around carrier with an improved partial end panel design which includes the benefits of the previous design and in addition has features which provide even greater protection against unwanted price scanning of individual articles.

BRIEF SUMMARY OF THE INVENTION

The invention comprises a wrap-around carrier having partial end panels formed of end panel flaps foldably connected to partially overlapping bottom panel flaps of the carrier. Preferably, each end panel flap includes at least one fold line extending upwardly from the associated bottom panel fold line to enable the end panel flaps to substantially follow the contour of the curved lower portion of adjacent articles. In addition, the end panel flaps are locked together in their contoured condition.

The means for locking associated end panel flaps together preferably comprises an opening in the free end portion of the overlapping end panel flaps such that the free end portion below the opening overlaps the adjacent free end portion of the other associated end panel flap while the free end portion above the opening is overlapped by the adjacent free end portion of the other associated end panel flap.

The end panel flaps are also connected to the side panels of the carrier, preferably by a foldably connected angle panel. The angle panel is foldably connected to an associated side panel locking flap which in turn is foldably connected to as associated side panel. Each angle panel contacts an outer bottom portion of an adjacent packaged article and each side panel locking flap is in substantial face-to-face engagement with an adjacent portion of the associated side panel. A portion of each side panel locking flap is in contact with an associated article to thereby hold the angle panels and the end panel flaps in place.

This design results in a carrier which can readily be formed to provide partial end panels that substantially follow the contour of adjacent articles, such as beverage cans, so as to adequately cover the pricing code even when the code is on portions of the end articles which are inwardly spaced from the ends of the bottom panel. The end panels are locked in place by the structure mentioned above. These and other aspects and benefits of the invention will readily be apparent from the more detailed description of the preferred embodiment of the invention which follows.

DETAILED DESCRIPTION OF THE PREFERRED EMBODIMENT

Figure 1:
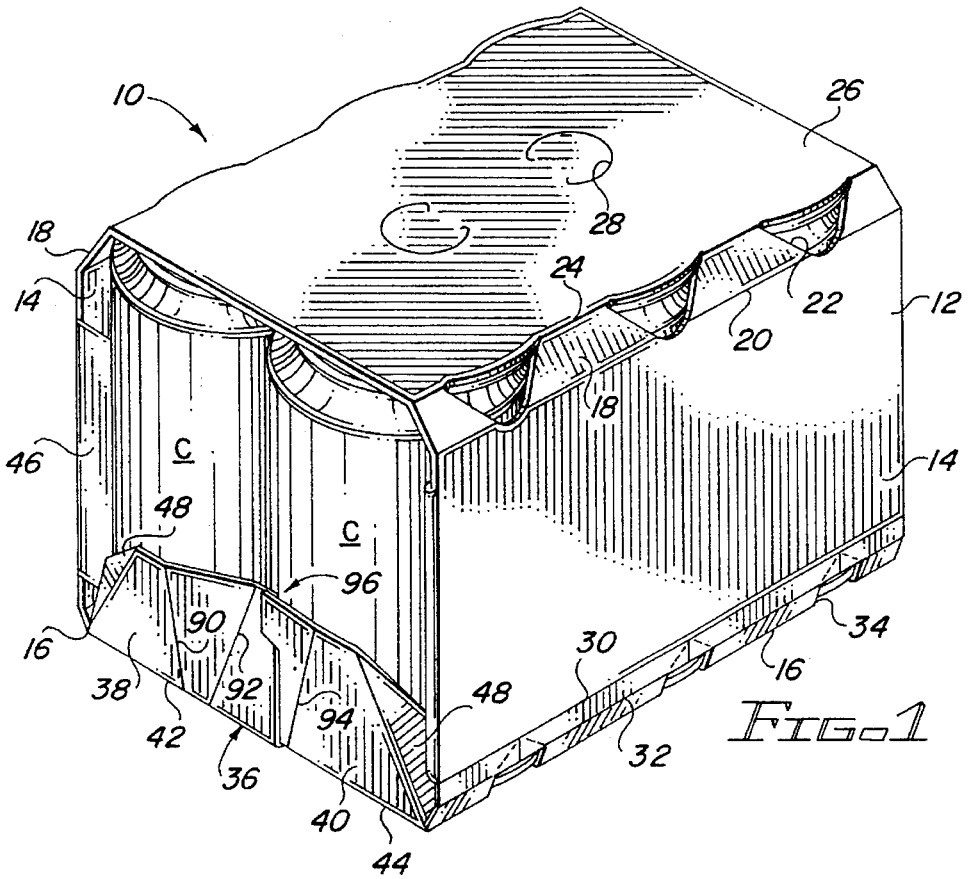
FIG. 1 is a pictorial view of the wrap-around carrier of the invention illustrated as part of a package containing six beverage cans.
Figure 2:
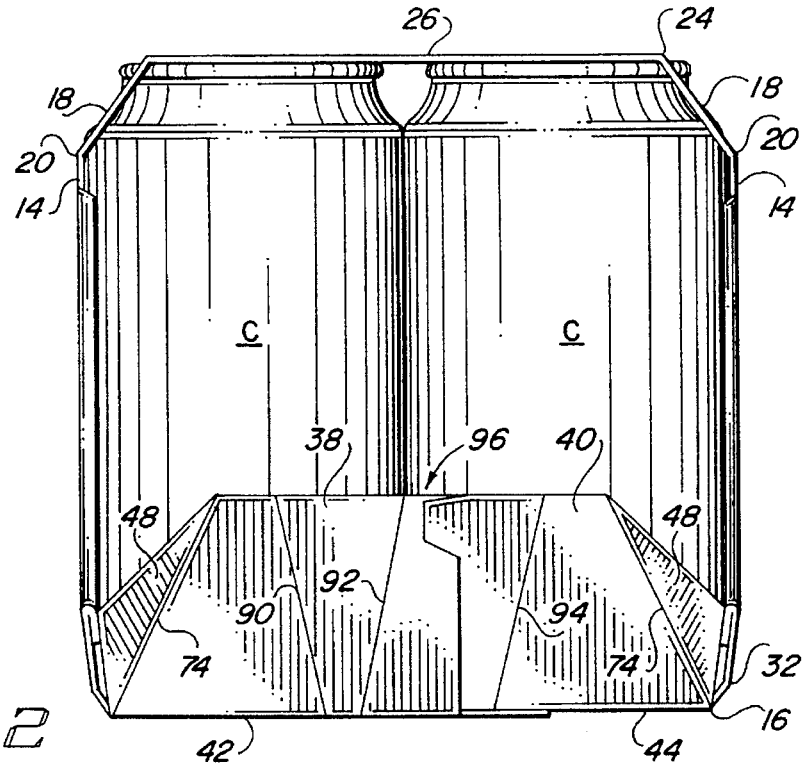
FIG. 2 is an end view of the carrier of FIG. 1.

Referring to FIGS. 1 and 2, a package 10 is comprised of a wrap-around carrier 12 containing six abutting beverage cans C, arranged in two rows of three cans each, supported on a bottom panel, not visible in these views. Side panels 14 are connected to the bottom panel along fold lines 16 and to short sloped shoulder panels 18 along fold lines 20. The sloped panels 18, which contain cutouts 22 through which the can chimes may protrude, permit the upper portions of the side panels to more closely conform to the tapered upper portions of the cans and are connected by fold lines 24 to top panel 26. The top panel includes finger holes 28 to facilitate lifting the carrier. In addition, the lower portion of the side panels includes score lines 30 and 32 which allow the wrapper to be pulled tightly about the bottom portion of the cans. Cutouts 34 are provided in the section between the fold lines 16 and 32 into which the bottom portions of the cans may extend to facilitate the step of tightly wrapping the carrier about the cans. The carrier also includes partial end panels 36 comprised of overlapping end panel flaps 38 and 40 connected to the bottom panel along fold lines 42 and 44. The end panel flaps 38 and 40 are connected to side panel locking flaps 46 by means of angle panels 48. As explained in more detail below, the side panel locking flaps and the angle panels cause the end panels to be folded into place. The end panel flap 38 includes two angled stress relief fold lines 90 and 92, while the end panel flap 40 includes a single stress relief fold line 94. These stress relief lines, in conjunction with the angle panel fold lines 74, enable the end panel to substantially follow the contour of adjacent cans, thereby closing the gap which would normally exist between a substantially planar end panel and the recessed point where the end cans contact each other. In addition, a lock, indicated generally at 96 and described in more detail below, is provided to maintain the end panel flaps in their illustrated positions.

Figure 3:
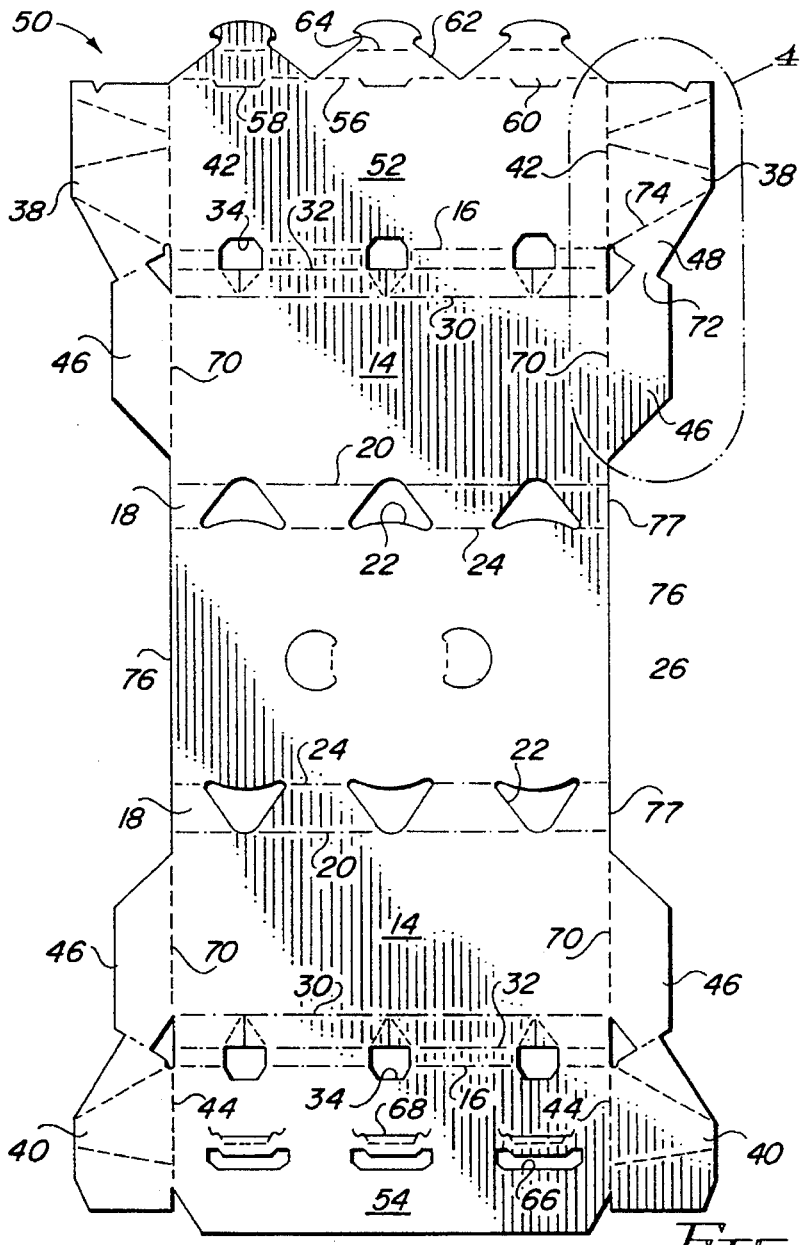
FIG. 3 is a plan view of a blank for forming the carrier of FIG. 1.
Figure 4:
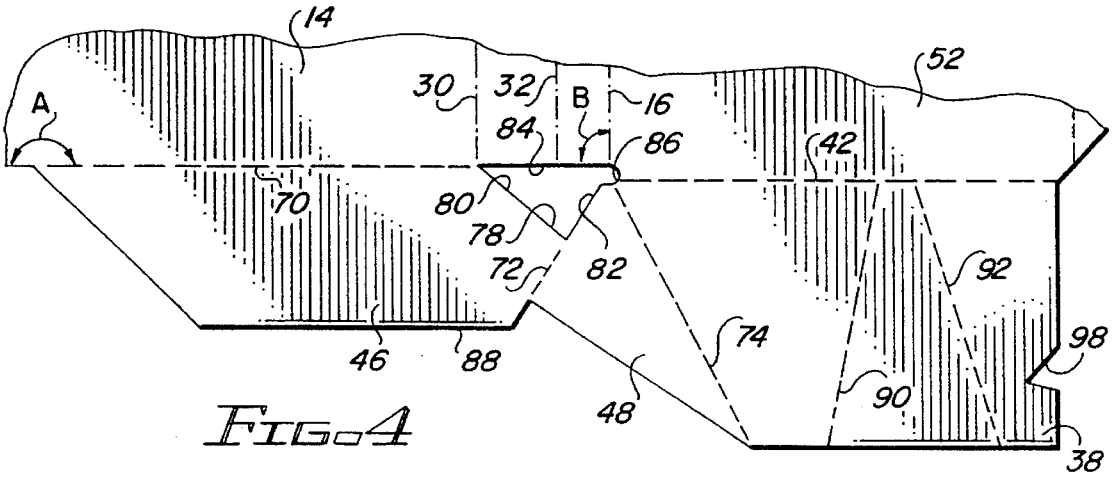
FIG. 4 is an enlarged plan view of the area within the oval 4 of FIG. 3.

Referring to FIGS. 3 and 4, wherein like reference numerals to those used in FIGS. 1 and 2 denote like elements, a generally rectangular blank 50 capable of being fabricated into the carrier of FIG. 1 includes a centrally located top panel section 26, adjacent short shoulder panel sections 18 connected by the fold lines 24 and side panel sections 14 connected to the short panel sections 18 by the fold lines 20. Connected to the side panel sections at the fold lines 16 at opposite ends of the blank are bottom panel flaps 52 and 54. The bottom panel flap 52, which is the outer bottom panel flap, includes a fold line 56 which is interrupted by slits 58 forming primary male locking tabs 60. Secondary male locking tabs 62 are connected along the fold line 56 and include an intermediate fold line 64. The bottom panel flap 54, which is the inner bottom panel flap, incorporates cutouts including primary female locking edges 66 adapted to engage the primary male locking tabs 60. The flap 54 also includes slits 68 adapted to receive the outer portions of the secondary locking tabs 62. Although these various locking elements are illustrated to demonstrate a typical bottom panel locking arrangement suitable for use with the carrier of the invention, it should be understood that any desired effective form of bottom panel locking means may be employed.

Still referring to FIGS. 3 and 4, the side panel locking flaps 46 are connected to the side panel sections 14 by fold lines 70, which terminate at the ends of the score lines 30. The angle panels 48 are connected to the side panel locking flaps 46 and the end panel flaps 38 and 40 by angled fold lines 72 and 74, respectively. Fold lines 42 and 44, which connect the end panel flaps to the bottom panel flaps, are substantially parallel to and aligned with the end edges 76 of the top panel section 26 and the end edges 77 of the shoulder panels 18. The fold line 70, however, is angled slightly inwardly for a reason explained below. This is best illustrated in FIG. 4 by the fact that the angle A, formed by an extension of the edge 77 and the fold line 70, is less than 180°. A cutout 78 is formed between adjacent side panel locking flaps and angle or gusset panels by the edge 80 of the side panel locking flap 46, the edge 82 of the angle panel 48 and the edge 84 of the lower portion of the side panel section 14. The edge 84 is a continuation of the angled fold line 70, and so terminates slightly inwardly of the fold lines 42 and 44. The outer end of the edge 84 is connected to the edge 82 of the cutout by a short arcuate edge 86, which also intersects the fold lines 42 and 44. Note that the fold line 72 terminates short of the outer edge 88 of the side panel locking flap 46.

Figure 5:
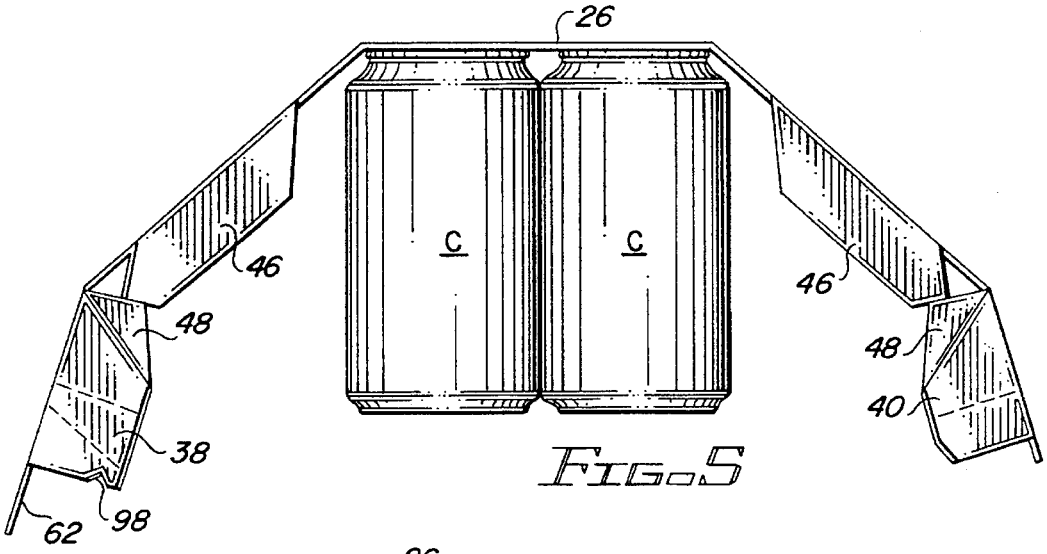
FIG. 5 is an end view of an initial stage of the carrier blank as it is being wrapped around a group of cans during formation of a carrier.

To form the package of FIG. 1, a blank is moved onto a group of six cans and the side panel sections 14 are folded about the fold lines 24 so that the can chimes extend into the cutouts 22. The bottom panel flaps 52 and 54 are then folded in along their fold lines 16 while at the same time pivoting the side panel locking flaps 46 in about the fold lines 70. Inward movement of the side panel locking flaps moves the fold line 72 inwardly, which pulls the angle panel 48 inwardly, folding up about the fold line 74. FIG. 5 illustrates the carrier at a representative point during this initial stage of fabrication.

Figure 6:
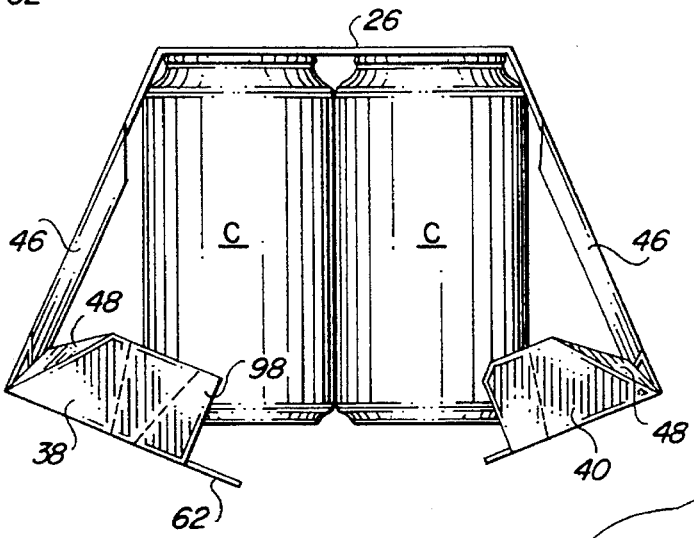
FIG. 6 is an end view similar to that of FIG. 5, but showing the carrier in a later stage of formation.

As the folding of the side panel sections, the bottom panel flaps and the side panel locking flaps continues, the side panel locking flaps move toward their final position in which they lie substantially flat against the connected side panel, while movement of the angle panels cause the end panel flaps to pivot to a position substantially at right angles to the connected bottom panel flap. The position of these elements just prior to arriving at their final positions is illustrated in FIG. 6. At this point the angle panels have been formed to fit around adjacent outer bottom portions of the cans when in their final position. The outer portions of the side panel locking flaps 46 which extend beyond the ends of the fold lines 72 are located so as to be pinched between the adjacent can and the adjacent side panel, thereby locking the side panel locking flaps in place. The final position of the side panel locking flaps and the angle panels with respect to each other and with respect to the end panel flaps is illustrated in FIG. 7.

Referring back now to FIGS. 3 and 4, as previously indicated the fold line 70 forms a slight angle with the end edge of the top panel. This causes the fold line 70 to form a slightly obtuse angle with the fold line 16, as indicated in FIG. 4 by the angle B. The purpose of having the fold line 70 angle in slightly is to cause the fold line 72 to move well into the interior of the carrier as the side panel locking flap 46 is pivoted into place, thereby causing the angle panels and end panel flaps to fold into their desired positions. This will not occur satisfactorily if the fold line 70 is angled outwardly and will not function as well even if it is an extension of the edge of the top panel. The cutout 80 serves to eliminate material which would otherwise bunch together and interfere with the folding of the adjacent elements. It also shortens the fold line 72, thereby reducing the pulling force necessary to cause the angle panels to fold about the fold lines 72.

Figure 7:
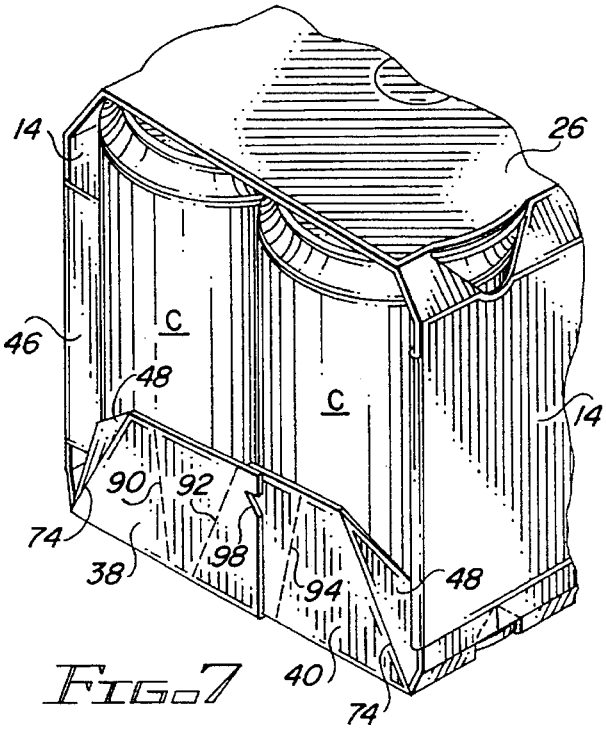
FIG. 7 is a partial pictorial view of the carrier prior to the end panels being moved to their final locked configuration.

If the partial end panels were comprised of substantially planar overlapping flaps, the mechanism described above would function to hold each end panel flap in its final vertical position, in the manner illustrated in FIG. 7, thereby forming an end panel without the need for gluing to maintain it in place. According to the present invention, however, the end panel flaps include stress relief lines which enable the flaps to substantially conform to the curvature of adjacent packaged cans or other cylindrically shaped objects. Thus, as shown in FIGS. 3 and 4 and as described in connection with FIGS. 1 and 2, the end panel flap 40 includes intermediate fold line 94 which extends from the fold line 44, in the direction of the fold line 74, to the outer edge of the flap. The end panel flap 38 includes two intermediate fold lines, fold line 90, which is comparable to the fold line 94, and fold line 92, which extends from the fold line 42 in a direction away from the fold line 90, to the outer edge of the flap 38. Since the end panel flap 38 overlaps the end panel flap 40, the flap 38 is somewhat longer than the flap 40 and has adequate space for the additional fold line 92. In addition, the end edge of the end panel flap 38 includes a locking notch 98.

Referring now to FIG. 7, the end panel flaps are illustrated as they would appear after the wrapper has been drawn around the packaged cans but prior to actuation of the end panel locking mechanism. The end panel flap 38 overlaps the end panel flap 40, but they both lie in substantially the same plane. When a force is applied to the end panel flap 38 just above the notch 98 in the direction of the interior of the package, the end portion of the flap 38 is pushed in toward the open area between the adjacent cans and the overlapping portion of the flap pushes the end portion of the flap 40 along with it. As this movement continues the upper portion of the flap 38 above the notch 98 flexes with respect to the upper portion of the flap 40, eventually snapping into place behind the flap 40 and causing the flaps to remain in the position of FIG. 1. As a result of these movements, the flaps fold slightly about the fold lines 74, 90 and 94, allowing the flaps to substantially follow the contour of the adjacent end cans. The end portion of the flap 38 will have folded slightly outwardly about the fold line 92 to lock the overlapped portion of the flap 40 in place as shown in FIGS. 1 and 2.

While the various folding steps described can be done by hand it is contemplated that they would be carried out in a packaging machine as the cans and blank are continuously moving through the machine. Although the carrier has been described in connection with the packaging of beverage cans, it is clear that the invention may be utilized in connection with the packaging of other types of articles as well. Although the details of locking the bottom panel flaps together have not been illustrated since the particular locking mechanism employed does not form part of the invention, it will be understood by those familiar with the locking elements shown that the locking tabs 62 are first folded back about the fold lines 56 and the primary male locking tabs 60 are then engaged with the primary female locking edges 60 in bottom panel flap 54. The outer portions of the secondary male locking tabs 62 are then inserted through the slits 68 to complete the mechanical locking action.

Although the formation of a carrier has been described in connection with a procedure in which the cans are upright and the blank is positioned on top of the cans, it will be appreciated that the cans may instead be inverted and moved onto a blank prior to folding of the blank.

It should now be apparent that the invention provides a means for covering the pricing code of end articles in a wrap-around carrier by automatically locking partial end panel flaps in place closely adjacent to the end articles. It will be understood, however, that the invention is not limited to all the specific details described in connection with the preferred embodiment and that changes to certain features of the preferred embodiment which do not alter the overall basic function and concept of the invention may be made without departing from the spirit and scope of the invention defined in the appended claims.

What is claimed is:

1. A package comprised of a wrap-around carrier containing two rows of adjacent articles having curved lower portions, comprising:

opposite side panels connected to top and bottom panels, the bottom panel being comprised of a first bottom panel flap partially overlapping a second bottom panel flap, each flap having opposite end edges;

a first end panel flap connected by a fold line to each of the end edges of the first bottom panel flap and a second end panel flap connected by a fold line to each of the end edges of the second bottom panel flap;

the first end panel flap at each end of the bottom panel partially overlapping the associated second end panel flap;

means in the overlapping portions of associated first and second end panel flaps for mechanically locking the associated first and second end panel flaps together; and each end panel flap including at least one fold line extending upwardly from the associated bottom panel fold line;

the end panel flaps contacting and substantially following the contour of the curved lower portion of adjacent articles.

2. A package as defined in claim 1, wherein the overlapping portions of the associated first and second end panel flaps include adjacent free end portions, the means for locking associated first add second end panel flaps together comprising an opening in the free end portion of each first end panel flap, the free end portion of the first end panel below the opening overlapping the adjacent free end portion of the associated second end panel flap and the free end portion of the first end panel above the opening being overlapped by the adjacent free end portion of the associated second end panel flap.

3. A package as defined in claim 2, wherein each opening is comprised of a notch having converging edges.

4. A package as defined in claim 1, wherein each first end panel flap has at least one more upwardly extending fold line than the second end panel flaps.

5. A package as defined in claim 1, wherein the means connecting each end panel flap to an adjacent side panel comprises a side panel locking flap connected to each end edge of the side panels along a fold line, an angle panel located between each end panel flap and an associated side panel locking flap, each angle panel being foldably connected to the associated end panel flap and side panel locking flap.

6. A package as defined in claim 5, wherein each angle panel is adjacent an article and contacts the curved lower portion thereof.

7. A package as defined in claim 6, wherein each side panel locking flap is in substantial face-to-face engagement with an adjacent portion of the associated side panel and a portion of each side panel locking flap is in contact with an associated article, whereby the locking panels are held in place by said contact.

8. A blank for forming a wrap-around carrier for packaging two rows of adjacent articles, comprising:

a sheet of generally rectangular shape including a centrally located top panel section;

opposite side panel sections connected to the top panel section by fold lines;

a first bottom panel flap connected to one of the side panel sections by a fold line, a second bottom panel flap connected to the other side panel section by a fold line, the first bottom panel flap partially overlapping the second bottom panel flap in a carrier formed from the blank;

the side panel sections and the bottom panel flaps having end edges;

a first end panel flap connected to each end edge of the first bottom panel flap along a fold line and a second end panel flap connected to each end edge of the second bottom panel flap along a fold line, each first end panel flap partially overlapping the associated second end panel flap;

means in the portions of the first and second end panel flaps which overlap in a carrier formed from the blank for mechanically locking associated first and second end panel flaps in such a carrier together; and each end panel flap including at least one fold line extending transversely from the associated bottom panel flap fold line, the transverse end panel flap fold lines permitting the end panel flaps to substantially follow the contour of curved lower portions of adjacent articles in a carrier formed from the blank.

9. A blank as defined in claim 8, wherein each first and second end panel flaps includes a free end portion, the means for locking associated first and second end panel flaps in a carrier formed from the blank comprising an opening in the free end portion of each first end panel flap, the free end portion of the first end panel below the opening in a carrier formed from the blank overlapping the adjacent free end portion of an associated second end panel flap and the free end portion of the first end panel above the opening being overlapped by the adjacent free end portion of the associated second end panel flap.

10. A blank as defined in claim 9, wherein each opening is comprised of a notch having converging edges.

11. A blank as defined in claim 8, wherein each first end panel flap has at least one more transversely extending fold line than the second end panel flaps.

12. A blank as defined in claim 8, including a side panel locking flap connected to each end edge of the side panels along a fold line, an angle panel located between each end panel flap and an associated side panel locking flap, each angle panel being foldably connected to the associated end panel flap and side panel locking flap.

13. A blank as defined in claim 12, wherein each side panel locking flap is in substantial face-to-face engagement with an adjacent portion of the associated side panel of a carrier formed from the blank and a portion of each side panel locking flap is in contact with an associated article in such a carrier, whereby the locking panels are held in place by said contact.

* * * * *